US009745844B2

(12) United States Patent
Aniket et al.

(10) Patent No.: US 9,745,844 B2
(45) Date of Patent: Aug. 29, 2017

(54) ESTIMATING CASING WEAR DURING DRILLING USING MULTIPLE WEAR FACTORS ALONG THE DRILL STRING

(71) Applicant: Landmark Graphics Corporation, Houston, TX (US)

(72) Inventors: Aniket, Houston, TX (US); Adolfo Gonzales, Houston, TX (US); Robello Samuel, Cypress, TX (US)

(73) Assignee: LANDMARK GRAPHICS CORPORATION, Houston, TX (US)

( * ) Notice: Subject to any disclaimer, the term of this patent is extended or adjusted under 35 U.S.C. 154(b) by 0 days.

(21) Appl. No.: 15/027,172

(22) PCT Filed: Jun. 12, 2015

(86) PCT No.: PCT/US2015/035468

§ 371 (c)(1),
(2) Date: Apr. 4, 2016

(87) PCT Pub. No.: WO2016/200397

PCT Pub. Date: Dec. 15, 2016

(65) Prior Publication Data

US 2017/0175515 A1 Jun. 22, 2017

(51) Int. Cl.

| | |
|---|---|
| ***E21B 47/00*** | (2012.01) |
| ***E21B 12/02*** | (2006.01) |
| ***E21B 41/00*** | (2006.01) |

(52) U.S. Cl.

CPC ..... *E21B 47/0006* (2013.01); *E21B 12/02* (2013.01); *E21B 41/0092* (2013.01)

(58) Field of Classification Search

CPC ..... E21B 47/0006; E21B 12/02; E21B 47/09; E21B 41/0092; E21B 17/10; G06F 17/5009; G01B 21/08

USPC ..... 175/40

See application file for complete search history.

(56) References Cited

U.S. PATENT DOCUMENTS

| | | | | |
|---|---|---|---|---|
| 8,862,436 | B2 | 10/2014 | Samuel | |
| 9,605,526 | B2 * | 3/2017 | Samuel | E21B 44/00 |
| 2014/0214326 | A1 | 7/2014 | Samuel et al. | |
| 2015/0176401 | A1 * | 6/2015 | Samuel | E21B 44/00 702/6 |

(Continued)

OTHER PUBLICATIONS

Hall et al., Recent Advances in Casing Wear Technology, IADC/SPE Drilling Conference, Dallas, Texas, 1994, IADC/SPE 27532.

(Continued)

*Primary Examiner* — Michael Wills, III
(74) *Attorney, Agent, or Firm* — McDermott Will & Emery LLP

(57) ABSTRACT

Estimating casing wear for individual portions or lengths of a casing may take into account that individual drill string sections cause different amounts of casing wear based on the physical and material properties of each drill string section. In some instances, a method performed during a drilling operation may involve tracking a location of the plurality of drill string sections along the wellbore; corresponding a casing section with the drill string wear factors of the drill string sections radially proximate to the casing section the drilling intervals of the drilling operations; and calculating a drilling casing wear for the casing section based on the drill string wear factors corresponding to the casing section.

20 Claims, 3 Drawing Sheets

(56) References Cited

U.S. PATENT DOCUMENTS

| | | | | |
|---|---|---|---|---|
| 2016/0119591 | A1* | 4/2016 | Samuel | E21B 21/066<br>175/24 |
| 2016/0230528 | A1* | 8/2016 | Samuel | E21B 12/02 |
| 2017/0022798 | A1* | 1/2017 | Samuel | E21B 47/0006 |

OTHER PUBLICATIONS

International Search Report and Written Opinion for PCT/US2015/035468 dated Mar. 11, 2016.

* cited by examiner

ESTIMATING CASING WEAR DURING DRILLING USING MULTIPLE WEAR FACTORS ALONG THE DRILL STRING

BACKGROUND

The embodiments described herein relate to estimating casing wear in the oil and gas industry.

Wellbores in the oil and gas industry are typically drilled in stages. Once a stage is drilled, it is often lined with a casing to provide wellbore wall stability to mitigate collapse and blowouts as additional stages are drilled. Because of this staged drilling and casing method, subsequent stages further from the surface typically exhibit a decrease in wellbore diameter.

When drilling below cased portions of the wellbore, the casing may wear due to contact with the drill string. This wear results in a decrease in casing thickness, which, in turn, weakens the casing. In order to avoid casing collapse or blowouts, it is advantageous to know the degree of wear that has taken place so that remedial actions may be taken when the casing thickness has sufficiently reduced. For these reasons, it is valuable to be able to determine the thickness of the casing at any given point.

The casing thickness may be determined spectroscopically by, for example, gamma rays tools. Such tools may be used after drilling the wellbore via a wireline operation to assess the casing thickness. However, this provides only a final assessment of the casing and does not allow for analysis of the casing thickness or integrity during the drilling operation itself.

To investigate casing thickness during drilling, such analysis tools may be placed along the drill string. However, the analysis tool can only assess the casing within a few feet along the wellbore relative to the analysis tool's current location. Accordingly, this does not provide an accurate assessment of the casing along the entire length of the wellbore.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The embodiments described herein relate to estimating casing wear for individual portions or lengths of a casing. Further, the embodiments described take into account that individual drill string sections may cause different amounts of casing wear based on the physical and material properties of each drill string section.

A drill string may include one or more of the following components: drill pipes, transition pipes (also known as "heavy weight drill pipes"), bottom hole assemblies (which may include, for example, drill collars, drill stabilizers, downhole motors, rotary steerable systems, measure-while-drilling tools, and logging-while-drilling tools), drill pipe protectors (which have reduced wear compared to the drill pipe), and the like, each of which may cause wear to the casing when the drill string is moved rotationally within and/or axially along the wellbore.

To perform the analyses described herein, drilling operations are divided (analytically, not physically) into intervals of depth (referred to herein as "drilling intervals"), and the casing that lines portions of a wellbore is divided (analytically, not physically) into sections of a given length (referred to herein as "casing sections"). For example, the drilling intervals may be 5 ft intervals, 20 ft intervals, 100 ft intervals, and so on. The casing sections may or may not have the same length as the drilling intervals.

Figure 1:
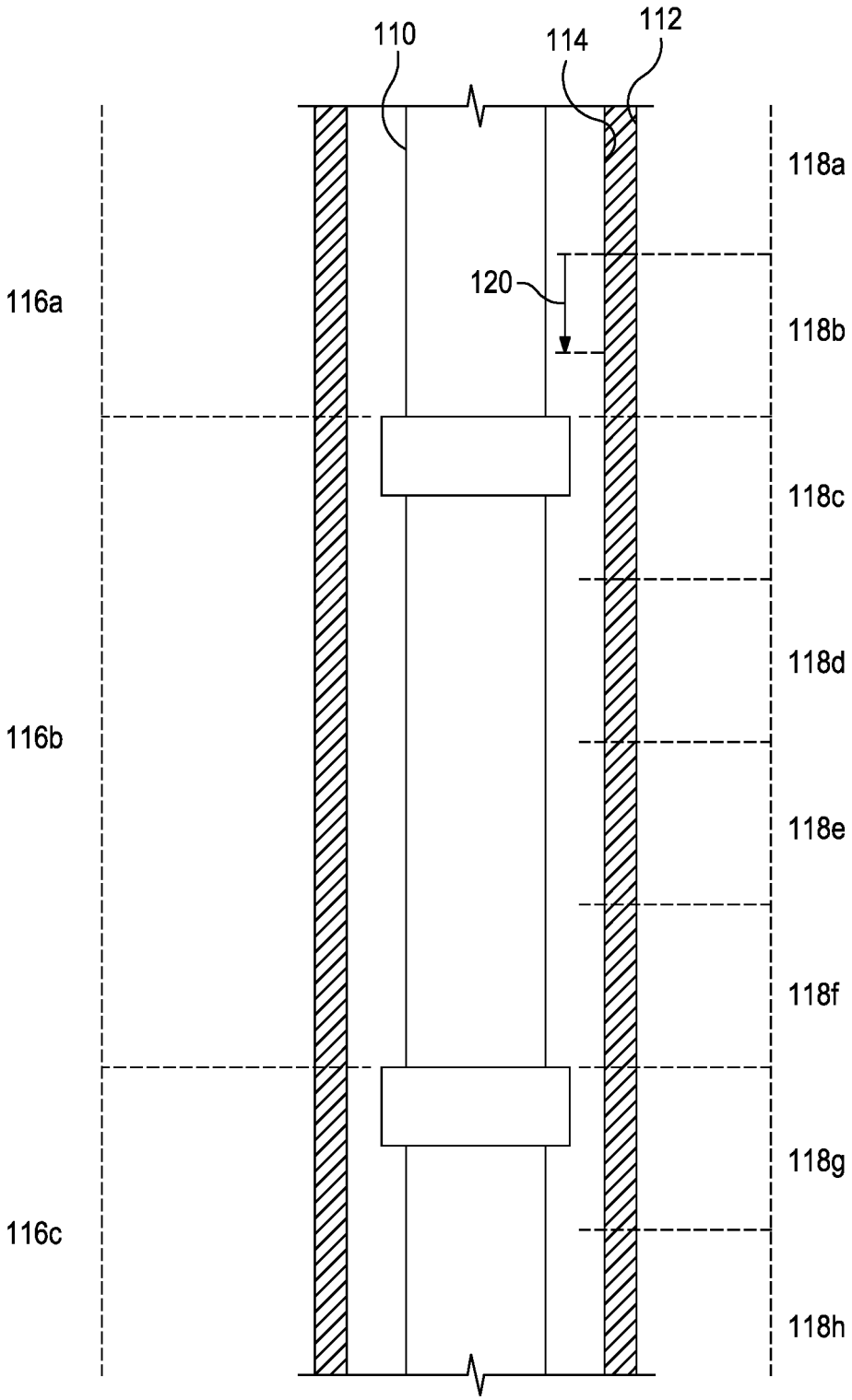
FIG. 1 provides a diagram of a portion drill string in a wellbore lined with casing.

FIG. 1 provides a diagram of a portion drill string 110 in a wellbore 112 that is lined with casing 114. The embodiments described herein monitor the location of individual drill string sections 116*a-c* in relation to casing sections 118*a-h*. Each drill string section 116*a-c* is assigned a drill string wear factor (DSWF) based on its physical and material properties. Table 1 provides an illustrative listing of DSWF corresponding to the individual drill string sections 116*a-c*. While Table 1 provides the DSWF/drill string section 116*a-c* correspondence based on sections, the correspondence may be based on any measurement that can be used to identify sections or lengths of the drill string (e.g., a distance from drill bit).

TABLE 1

| Drill String Section | Wear Factor | Distance from Drill Bit |
|---|---|---|
| 116a | 25 | 4125 ft to 5100 ft |
| 116b | 40 | 3850 ft to 4125 ft |
| 116c | 120 | 2100 ft to 3850 ft |

In alternate embodiments, a default DSWF may be used and drill string sections having a DSWF different than the default DSWF may be identified and corresponded to their respective DSWF. For example, Table 2 provides an exemplary description of a drill string by its DSWF. The default DSWF may be the DSWF for the drill pipe that composes the majority of the drill string. Additional components to the drill string (e.g., transition pipes and bottom hole assemblies) may each have a DSWF and a distance from drill bit based on the components' location along the drill string.

TABLE 2

| Wear Factor | Distance from Drill Bit |
|---|---|
| 2 | default (use unless otherwise specified) |
| 25 | 400 ft to 800 ft |
| 40 | 2100 ft to 2400 ft |
| 120 | 3255 ft to 4125 ft |
| 20 | 5100 ft to 5250 ft |

Referring again to FIG. 1, the location of each drill string section 116*a-c* is tracked during each drilling interval 120. For each drilling interval 120, individual casing sections 118*a-h* are correlated to the DSWF of the corresponding drill string section 116*a-c*. For example, as illustrated in FIG. 1, the top two casing sections 118*a-b* would be correlated with the DSWF for the top drill string section 116*a;* the next four casing sections 118*c-f* would be correlated with the DSWF for the middle drill string section 116*b;* and the bottom two casing sections 118*g-h* would be correlated with the DSWF for the bottom drill string section 116*c*. Then, when the next drilling interval 120 is drilled, the correlation of casing sections 118*a-h* to the DSWF of the drill string sections 116*a-c* is performed again.

The casing wear for each casing section 118*g-h* may then be analyzed (qualitatively or quantitatively) based on the plurality of DSWFs correlated thereto. For example, the plurality of DSWFs may be applied to estimate casing wear along a particular casing section for each drilling interval.

Figure 2:
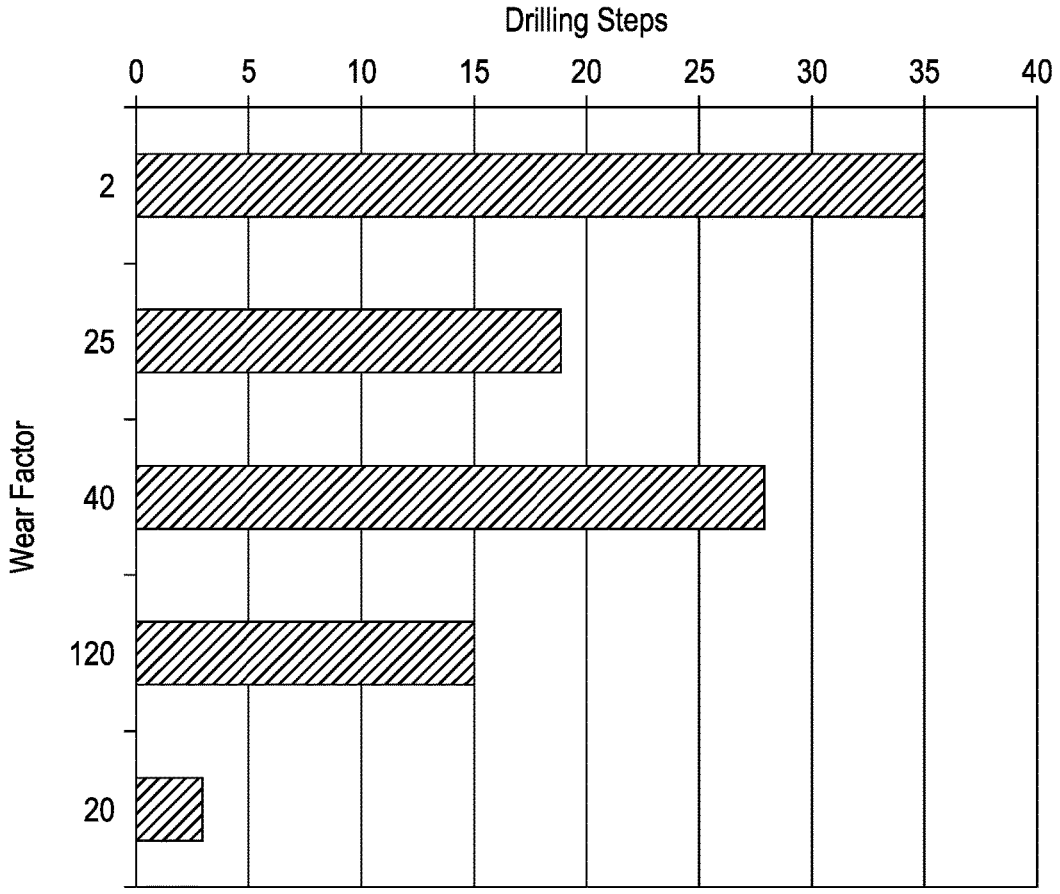
FIG. 2 provides an illustrative bar graph representing the drill string wear factors (DSWFs) experienced by an individual casing section after drilling a plurality of drilling intervals.

Estimating casing wear may be achieved by a plurality of methods. For example, in some instances, the DSWFs experienced by each casing sections may be represented graphically, such as with a bar graph or a pie graph. FIG. 2 provides an illustrative bar graph that may be presented to represent the DSWFs experienced by an individual casing section after drilling a plurality of drilling intervals with a drill string configured according to Table 2. In the illustrated graph, the casing section experienced portions of the drill string with a 2 wear factor 35 times, a 25 wear factor 19 times, a 40 wear factor 28 times, a 120 wear factor 15 times, and a 20 wear factor 3 times. The bar graph of FIG. 2, or related graphical representations of the casing wear factors experienced by individual casing sections, may be used to estimate the drilling casing wear for each of the casing sections. For example, the casing wear may be calculated where each DSWF and the number of times each DSWF was experienced may be used in known methods and/or algorithms for applying a casing wear factor to yield the casing wear due to drilling (also referred to as "drilling casing wear"). The drilling casing wear may be reported as a volume of casing worn away (also referred to as "casing wear volume"), a percentage of casing worn away (also referred to herein as "casing wear percentage"), a thickness of casing remaining, a percentage of casing remaining, or a combination thereof.

In another example, the drilling casing wear for an individual casing section may be calculated by first calculating the casing wear for the individual casing section at each drilling interval (according to known methods and/or algorithms) and then adding together the casing wears from each drilling interval performed during drilling operation. The drilling casing wear may be reported as a casing wear volume, a casing wear percentage, a thickness of casing remaining, a percentage of casing remaining, or a combination thereof.

In yet another example of estimating casing wear, an average casing wear factor ($CWF_{avg}$) factor may be calculated for a casing section according to Equation 1 below that weights the $CWF_{avg}$ based on the number of times each DSWF is associated with the particular casing section, where n is the number of DSWF and $N_{DSWF}$ is number of times $DSWF_i$ is correlated with the particular casing section.

$$CWF_{avg} = \frac{\sum_{i=1}^{n} DSWF_i * N_{DSWF,i}}{\sum_{i=1}^{n} N_{DSWF,i}} \quad \text{Equation 1}$$

The $CWF_{avg}$ may optionally be used to estimate drilling casing wear, where the $CWF_{avg}$ is used as the casing wear factor in the known methods and/or algorithms for calculating the drilling casing wear. The drilling casing wear may be reported as a casing wear volume, a casing wear percentage, a thickness of casing remaining, a percentage of casing remaining, or a combination thereof.

The drilling casing wear estimated using graphical representations, $CWF_{avg}$, or both may be used as an input for a casing wear model that estimates a total casing wear due to a plurality of wear types, which may also include, for example, casing wear during reciprocation casing wear (i.e., casing wear caused by the drill string when the drill string is reciprocated in the wellbore, which is often performed to smooth portions of newly drilled wellbore), tripping casing wear (i.e., casing wear caused by the drill string when pulling the drill string out of the wellbore, which is often performed to replace or repair the drill bit, portions of the drill string, or tools coupled to the drill string), backreaming casing wear (i.e., casing wear caused by the drill string when stroking and rotating the drill string while simultaneously pulling out of the hole, which is often performed during the initial steps of tripping a drill string from a deviated wellbore or when increasing the gauge of the wellbore), rotating off bottom casing wear (i.e., casing wear caused by the drill string when the drill string is rotated without reciprocation), non-drilling casing wear (e.g., in off-shore well sites, sea heave may cause the platform to move and, consequently, axial motion of the drill string along the wellbore), sliding casing wear (e.g., casing wear caused by the drill string when the drill string is not rotated but the drill bit coupled thereto is rotated with a mud motor), and the like. These casing wear models may, in some instances, be a summation of the plurality of wear types.

The total casing wear may be expressed as a casing wear volume, a casing wear percentage, a thickness of casing remaining, a percentage of casing remaining, or a combination thereof.

The drilling casing wear and/or total casing wear may be used to determine when there has been sufficient casing wear to potentially compromise the integrity of the casing section. This may be done by one of many methods. For example, casing sections may have threshold drilling casing wear value and/or a threshold total casing wear value that are set based on the physical and material properties of the casing sections. In another example, the drilling casing wear and/or the total casing wear may be used to estimate a thickness of the casing sections that should be used in the well to prevent any failures based on known calculations taking into account the physical and material properties of the casing sections.

The analyses described herein may, in some embodiments, be used during a drilling operation. For example, while drilling a wellbore penetrating a subterranean formation, the location of the drill string sections, and their corresponding DSWF, may be tracked and correlated to casing sections at each drilling interval. The total casing wear may be calculated and analyzed continuously while drilling, after a predetermined number of drilling intervals, on-demand, or any combination thereof.

When the casing wear for one or more of the casing sections indicates that the integrity of the one or more of the casing sections may be compromised, a remedial action may be taken. For example, one or more of the casing sections may be reinforced with liners, screens, or the like. In another example, the drilling operation parameters may be adjusted to keep the total casing wear below threshold total casing wear values, which mitigates casing failure. In yet another example, the drill string components may be modified to change the DSWFs to help reduce the casing wear, including the use of drill pipe protectors to reduce the casing wear. In some instances, an alert signal may be sent (e.g., to an operator) when the total casing wear approaches, reaches, or exceeds the threshold value.

Figure 3:
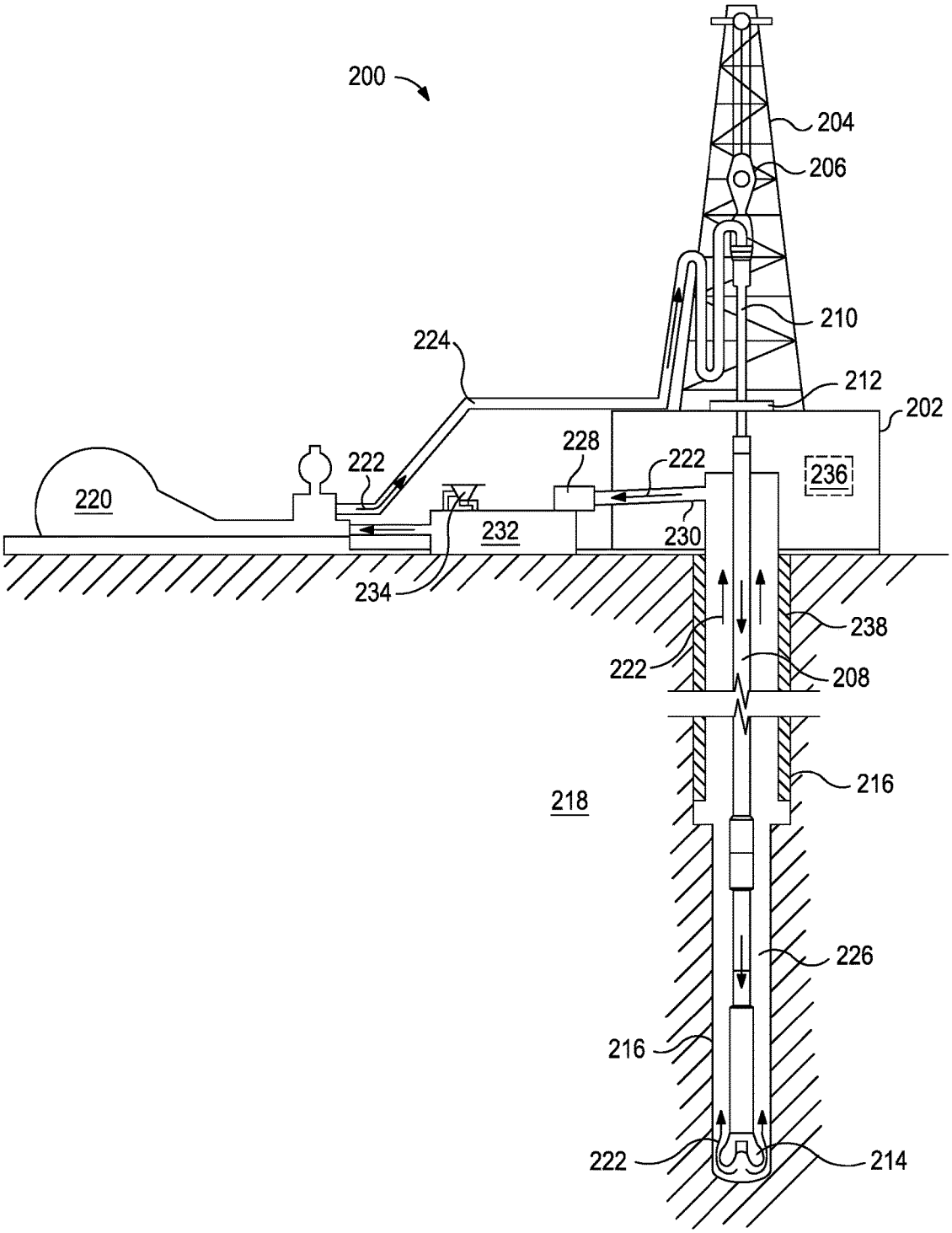
FIG. 3 illustrates an exemplary wellbore drilling assembly suitable for implementing the analyses described herein, according to one or more embodiments.

FIG. 3 illustrates an exemplary wellbore drilling assembly 200 suitable for implementing the analyses described herein, according to one or more embodiments. It should be noted that while FIG. 3 generally depicts a land-based drilling assembly, those skilled in the art will readily recognize that the principles described herein are equally applicable to subsea drilling operations that employ floating or sea-based platforms and rigs, without departing from the scope of the disclosure.

As illustrated, the drilling assembly 200 may include a drilling platform 202 that supports a derrick 204 having a traveling block 206 for raising and lowering a drill string 208. The drill string 208 may include, but is not limited to, drill pipe and coiled tubing, as generally known to those skilled in the art. A kelly 210 supports the drill string 208 as it is lowered through a rotary table 212. A drill bit 214 is attached to the distal end of the drill string 208 and is driven either by a downhole motor and/or via rotation of the drill string 208 from the well surface. As the bit 214 rotates, it creates a wellbore 216 that penetrates various subterranean formations 218. As illustrated, the wellbore 216 is partially lined with casing 238. The wear for casing 238 or sections thereof may be evaluated according to the analyses and methods described herein.

A pump 220 (e.g., a mud pump) circulates drilling fluid 222 through a feed pipe 224 and to the kelly 210, which conveys the drilling fluid 222 downhole through the interior of the drill string 208 and through one or more orifices in the drill bit 214. The drilling fluid 222 is then circulated back to the surface via an annulus 226 defined between the drill string 208 and the walls of the wellbore 216. At the surface, the recirculated or spent drilling fluid 222 exits the annulus 226 and may be conveyed to one or more fluid processing unit(s) 228 via an interconnecting flow line 230. After passing through the fluid processing unit(s) 228, a "cleaned" drilling fluid 222 is deposited into a nearby retention pit 232 (i.e., a mud pit). While illustrated as being arranged at the outlet of the wellbore 216 via the annulus 226, those skilled in the art will readily appreciate that the fluid processing unit(s) 228 may be arranged at any other location in the drilling assembly 200 to facilitate its proper function, without departing from the scope of the disclosure.

Additives may be added to the drilling fluid 222 via a mixing hopper 234 communicably coupled to or otherwise in fluid communication with the retention pit 232. The mixing hopper 234 may include, but is not limited to, mixers and related mixing equipment known to those skilled in the art. In other embodiments, however, the additives may be added to the drilling fluid 222 at any other location in the drilling assembly 200. In at least one embodiment, for example, there could be more than one retention pit 232, such as multiple retention pits 232 in series. Moreover, the retention pit 232 may be representative of one or more fluid storage facilities and/or units where the additives may be stored, reconditioned, and/or regulated until added to the drilling fluid 222.

The drilling assembly 200 may further include a control system 236 that may, inter alia, perform the analyses described herein.

The analyses described herein may, in some embodiments, be used when designing a drilling operation. For example, when a drilling operation is simulated (e.g., using mathematical models stored and executed on a control system), the casing wear factor and/or the total casing wear for casing sections may be analyzed. If, during the simulation, the casing wear factors and/or the total casing wear indicate that the integrity of the one or more of the casing sections may be compromised, the drilling operation design may be altered.

In some instances, drill string sections or components with higher DSWF may be replaced with drill string sections having a lower DSWF to mitigate casing wear. By way of nonlimiting example, a bar graph or other graphical representation of the DSWFs experienced by an individual casing section after drilling a plurality of drilling intervals with a drill string (e.g., the bar graph of FIG. 2) may be used to illustrate that drilling casing wear from specific components, which may or may not have the greatest wear factor, occur more often (e.g., wear factor 40 occurs more often than wear factor 120 in FIG. 2). Accordingly, the components with the wear factor most experienced by the casing section may be changed or protected with a drill string protector, which, in some instances, may reduce the wear factor to less than 1.

In another example, the casing or portions thereof may be replaced with a casing that can withstand greater wear.

In yet another example, the drilling operation parameters may be adjusted to keep the total casing wear below threshold total casing wear values, which mitigates casing failure.

In some instances, an alert signal may be sent (e.g., to an operator designing the drilling operation) when the total casing wear approaches (e.g., is within 10% of the threshold value), reaches, or exceeds the threshold value.

A combination of the foregoing examples to mitigate drilling casing wear and total casing wear may also be implemented.

The control system(s) 236 (e.g., used at a drill site or in simulating a drilling operation) and corresponding computer hardware used to implement the various illustrative blocks, modules, elements, components, methods, and algorithms described herein can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable programmable read only memory (EPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

For example, the control system(s) 236 described herein may be configured for receiving inputs, which may be real or simulated data, that may include, but are not limited to, the configuration of the drill string (e.g., the length and/or composition of each drill string section, the ordering thereof, and the like), the DSWF corresponding to each drill string, the configuration of the casing (e.g., the depth and diameter of the casing), the analysis parameters (e.g., the length assigned to casing sections), the depth of the drill bit (e.g., which may be used to track the location of each drill string section relative to the casing sections), and the like. The processor may also be configured to correlate a DSWF to each casing section for each drilling interval as described herein and produce an output relating to the casing wear (e.g., casing wear due to drilling and/or total casing wear) for each casing section. The output may be a numerical value indicative of casing wear (e.g., casing wear due to drilling and/or total casing wear), a pictorial representation of casing wear (e.g., a graph or a color-coded figure that correlates casing wear due to drilling and/or total casing wear to depth), or the like. These casing wear outputs may relate to individual casing sections, a plurality of casing sections, or all casing sections of the casing.

When total casing wear is at least a portion of the output, a casing wear model described herein may be used and the processor may receive inputs relating to other casing wear mechanisms like tripping casing wear, reciprocation casing wear, backreaming casing wear, rotating off bottom casing wear, sliding casing wear, and the like.

In some instances, the processor may also be configured to send an alert signal (e.g., to an operator or other processor at the drill site, at a remote site from the drill site, or at the drilling simulation) that the casing wear during drilling and/or the total casing wear indicates that the integrity of the one or more of the casing sections may be compromised.

Embodiments disclosed herein include:

Embodiment A: a method that includes drilling a wellbore penetrating a subterranean formation with a drill bit coupled to an end of a drill string extending into the wellbore, wherein a portion of the wellbore is lined with casing and the drill string includes a plurality of drill string sections each having a drill string wear factor; tracking a location of the plurality of drill string sections along the wellbore; analytically dividing progress of the drill bit into a plurality of drilling intervals, wherein each drilling interval has a depth; analytically dividing the casing into a plurality of casing sections, wherein each casing section has a length; corresponding at least some of the plurality of casing sections with the drill string wear factor of the drill string section radially proximate to each of the plurality of casing sections for at least some of the plurality of drilling intervals; and calculating a drilling casing wear for at least one of the plurality of casing sections based on the drill string wear factors corresponding to the at least one of the plurality of casing sections;

Embodiment B: a method that includes simulating a drilling operation with a mathematical model of drilling a wellbore penetrating a subterranean formation with a drill bit coupled to an end of a drill string extending into the wellbore, wherein a portion of the wellbore is lined with casing and the drill string includes a plurality of drill string sections each having a drill string wear factor, the mathematical model being stored in a non-transitory medium readable by a processor for execution by the processor; tracking a location of the plurality of drill string sections along the wellbore; analytically dividing progress of the drill bit into a plurality of drilling intervals, wherein each drilling interval has a depth; analytically dividing the casing into a plurality of casing sections, wherein each casing section has a length; corresponding at least some of the plurality of casing sections with the drill string wear factor of the drill string section radially proximate to each of the plurality of casing sections for at least some of the plurality of drilling intervals; and calculating a drilling casing wear for at least one of the plurality of casing sections based on the drill string wear factors corresponding to the at least one of the plurality of casing sections;

Embodiment C: a drilling system that includes a drill bit coupled to an end of a drill string extending into a wellbore, wherein a portion of the wellbore is lined with casing; a pump operably connected to the drill string for circulating a drilling fluid through the wellbore; a control system that includes a non-transitory medium readable by a processor and storing instructions for execution by the processor for performing a method comprising: tracking a location of the plurality of drill string sections along the wellbore; analytically dividing progress of the drill bit as it drills the wellbore into a plurality of drilling intervals, wherein each drilling interval has a depth; analytically dividing the casing into a plurality of casing sections, wherein each casing section has a length; corresponding at least some of the plurality of casing sections with the drill string wear factor of the drill string section radially proximate to each of the plurality of casing sections for at least some of the plurality of drilling intervals; and analyzing a casing wear for at least one of the plurality of casing sections based on the drill string wear factors corresponding to the at least one of the plurality of casing sections; and Embodiment D: a non-transitory medium readable by a processor and storing instructions for execution by the processor for performing a method comprising: tracking a location of a plurality of drill string sections along a wellbore that is at least partially lined with casing; analytically dividing progress of a drill bit coupled to an end of the drill string sections as it drills the wellbore into a plurality of drilling intervals, wherein each drilling interval has a depth; analytically dividing the casing into a plurality of casing sections, wherein each casing section has a length; corresponding at least some of the plurality of casing sections with a drill string wear factor of the drill string section radially proximate to each of the plurality of casing sections for at least some of the plurality of drilling intervals; and analyzing a casing wear for at least one of the plurality of casing sections based on the drill string wear factors corresponding to the at least one of the plurality of casing sections.

Each of embodiments A, B, and C may have one or more of the following additional elements in any combination: Element 1: wherein calculating the drilling casing wear for the at least one of the plurality of casing sections involves calculating a $CWF_{avg}$ for the at least one of the plurality of casing sections according to Equation 1; Element 2: the method further including: assigning a threshold value for the drilling casing wear for the at least one of the plurality of casing sections; and performing a remedial operation on the at least one of the plurality of casing sections when the drilling casing wear exceeds the threshold value; Element 3: the method further including: assigning a threshold value for the drilling casing wear for the at least one of the plurality of casing sections; and applying a drill string protector to one or more drill string sections when the drilling casing wear exceeds the threshold value; Element 4: the method further including: assigning a threshold value for the drilling casing wear for the at least one of the plurality of casing sections; and sending an alert signal when the drilling casing wear approaches, reaches, or exceeds the threshold value; Element 5: the method further including: calculating a total casing wear for the at least one of the plurality of casing sections drilling using a casing wear model based on the drilling casing wear and at least one of a tripping casing wear, a reciprocation casing wear, a backreaming casing wear, a rotating off bottom casing wear, or sliding casing wear; Element 6: the method further including: Element 5 and assigning a threshold value for the total casing wear for the at least one of the plurality of casing sections; and performing a remedial operation on the at least one of the plurality of casing sections when the total casing wear exceeds the threshold value; Element 7: the method further including: Element 5 and assigning a threshold value for the total casing wear for the at least one of the plurality of casing sections; and applying a drill string protector to one or more drill string sections when the total casing wear exceeds the threshold value; Element 8: the method further including: Element 5 and assigning a threshold value for the total casing wear for the at least one of the plurality of casing sections; and sending an alert signal when the total casing wear approaches, reaches, or exceeds the threshold value; and Element 9: the method further including: wherein calculating the drilling casing wear for the at least one of the plurality of casing sections involves analyzing a number of times each drill string wear factor corresponds to the at least one of the plurality of casing sections; and wherein the method further comprises changing a configuration of the drill string by applying drill string protectors to one or more of the plurality of drill string sections.

By way of non-limiting example, exemplary combinations applicable to Embodiments A, B, C, and D include: Element 1 in combination with one or more of Elements 2-4; Element 1 in combination with Element 5 and optionally further in combination with one or more of Elements 6-9; Element 1 in combination with Element 9; two or more of Elements 2-4 in combination; one or more of Elements 2-4 in combination with Element 5 and optionally further in combination with one or more of Elements 6-8; Element 5 in combination with Element 9 and optionally further in combination with one or more of Elements 6-8; Element 5 in combination with two or more of Elements 6-8; and any combination thereof.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

While compositions and methods are described herein in terms of "comprising" various components or steps, the compositions and methods can also "consist essentially of" or "consist of" the various components and steps.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A method comprising:

drilling a wellbore with a drill bit coupled to an end of a drill string extending into the wellbore, wherein a portion of the wellbore is lined with casing and the drill string includes a plurality of drill string sections each having a drill string wear factor;

tracking a location of the plurality of drill string sections along the wellbore;

analytically dividing progress of the drill bit into a plurality of drilling intervals, wherein each drilling interval has a depth;

analytically dividing the casing into a plurality of casing sections, wherein each casing section has a length;

corresponding at least some of the plurality of casing sections with the drill string wear factor of the drill string section radially proximate to each of the plurality of casing sections for at least some of the plurality of drilling intervals; and calculating a drilling casing wear for at least one of the plurality of casing sections based on the drill string wear factors corresponding to the at least one of the plurality of casing sections.

2. The method of claim 1, wherein calculating the drilling casing wear for the at least one of the plurality of casing sections comprises calculating an average casing wear factor ($CWF_{avg}$) for the at least one of the plurality of casing sections according to Equation 1 and calculating the drilling casing wear based on the $CWF_{avg}$, wherein n is the number of drill string factors associated with the at least one of the plurality of casing sections and $N_{DSWF}$ is number of times each drill string factor is correlated with the at least one of the plurality of casing sections $$CWF_{avg} = \frac{\sum_{i=1}^{n} DSWF_i * N_{DSWF,i}}{\sum_{i=1}^{n} N_{DSWF,i}}. \quad \text{Equation 1}$$

3. The method of claim 1 further comprising:

assigning a threshold value for the drilling casing wear for the at least one of the plurality of casing sections; and performing a remedial operation on the at least one of the plurality of casing sections when the drilling casing wear exceeds the threshold value.

4. The method of claim 1 further comprising:

assigning a threshold value for the drilling casing wear for the at least one of the plurality of casing sections; and applying a drill string protector to one or more drill string sections when the drilling casing wear exceeds the threshold value.

5. The method of claim 1 further comprising:

assigning a threshold value for the drilling casing wear for the at least one of the plurality of casing sections; and sending an alert signal when the drilling casing wear approaches, reaches, or exceeds the threshold value.

6. The method of claim 1, further comprising:

calculating a total casing wear for the at least one of the plurality of casing sections drilling using a casing wear model based on the drilling casing wear and at least one of a tripping casing wear, a reciprocation casing wear, a backreaming casing wear, a rotating off bottom casing wear, or sliding casing wear.

7. The method of claim 5 further comprising:

assigning a threshold value for the total casing wear for the at least one of the plurality of casing sections; and performing a remedial operation on the at least one of the plurality of casing sections when the total casing wear exceeds the threshold value.

8. The method of claim 5 further comprising:

assigning a threshold value for the total casing wear for the at least one of the plurality of casing sections; and applying a drill string protector to one or more drill string sections when the total casing wear exceeds the threshold value.

9. The method of claim 5 further comprising:

assigning a threshold value for the total casing wear for the at least one of the plurality of casing sections; and sending an alert signal when the total casing wear approaches, reaches, or exceeds the threshold value.

10. A method comprising:

simulating a drilling operation with a mathematical model of drilling a wellbore with a drill bit coupled to an end of a drill string extending into the wellbore, wherein a portion of the wellbore is lined with casing and the drill string includes a plurality of drill string sections each having a drill string wear factor, the mathematical model being stored in a non-transitory medium readable by a processor for execution by the processor;

tracking a location of the plurality of drill string sections along the wellbore;

analytically dividing progress of the drill bit into a plurality of drilling intervals, wherein each drilling interval has a depth;

analytically dividing the casing into a plurality of casing sections, wherein each casing section has a length;

corresponding at least some of the plurality of casing sections with the drill string wear factor of the drill string section radially proximate to each of the plurality of casing sections for at least some of the plurality of drilling intervals; and calculating a drilling casing wear for at least one of the plurality of casing sections based on the drill string wear factors corresponding to the at least one of the plurality of casing sections.

11. The method of claim 10, wherein calculating the drilling casing wear for the at least one of the plurality of casing sections involves calculating an average casing wear factor ($CWF_{avg}$) for the at least one of the plurality of casing sections according to Equation 1 and calculating the drilling casing wear based on the $CWF_{avg}$, wherein n is the number of drill string factors associated with the at least one of the plurality of casing sections and $N_{DSWF}$ is number of times each drill string factor is correlated with the at least one of the plurality of casing sections $$CWF_{avg} = \frac{\sum_{i=1}^{n} DSWF_i * N_{DSWF,i}}{\sum_{i=1}^{n} N_{DSWF,i}}. \quad \text{Equation 1}$$

12. The method of claim 10 further comprising:

assigning a threshold value for the drilling casing wear for the at least one of the plurality of casing sections; and changing a parameter of the drilling operation when the drilling casing wear exceeds the threshold value.

13. The method of claim 10 further comprising:

assigning a threshold value for the drilling casing wear for the at least one of the plurality of casing sections; and changing a configuration of the drill string when the drilling casing wear exceeds the threshold value.

14. The method of claim 13, wherein changing the configuration of the drill string includes applying a drill pipe protector to one or more drill string sections.

15. The method of claim 10 further comprising:

assigning a threshold value for the drilling casing wear for the at least one of the plurality of casing sections; and sending an alert signal when the drilling casing wear approaches, reaches, or exceeds the threshold value.

16. The method of claim 10, further comprising:

calculating a total casing wear for the at least one of the plurality of casing sections drilling using a casing wear model based on the drilling casing wear and at least one of a tripping casing wear, a reciprocation casing wear, a backreaming casing wear, a rotating off bottom casing wear, or sliding casing wear.

17. The method of claim 16 further comprising:

assigning a threshold value for the total casing wear for the at least one of the plurality of casing sections; and performing a remedial operation on the at least one of the plurality of casing sections when the total casing wear exceeds the threshold value.

18. The method of claim 10, wherein calculating the drilling casing wear for the at least one of the plurality of casing sections involves analyzing a number of times each drill string wear factor corresponds to the at least one of the plurality of casing sections; and wherein the method further comprises changing a configuration of the drill string by applying drill string protectors to one or more of the plurality of drill string sections.

19. A drilling system comprising:

a drill bit coupled to an end of a drill string extending into a wellbore, wherein a portion of the wellbore is lined with casing;

a pump operably connected to the drill string for circulating a drilling fluid through the wellbore;

a control system that includes a non-transitory medium readable by a processor and storing instructions for execution by the processor for performing a method comprising:

tracking a location of the plurality of drill string sections along the wellbore;

analytically dividing progress of the drill bit as it drills the wellbore into a plurality of drilling intervals, wherein each drilling interval has a depth;

analytically dividing the casing into a plurality of casing sections, wherein each casing section has a length;

corresponding at least some of the plurality of casing sections with the drill string wear factor of the drill string section radially proximate to each of the plurality of casing sections for at least some of the plurality of drilling intervals; and analyzing a casing wear for at least one of the plurality of casing sections based on the drill string wear factors corresponding to the at least one of the plurality of casing sections.

20. A non-transitory medium readable by a processor and storing instructions for execution by the processor for performing a method comprising:

tracking a location of a plurality of drill string sections along a wellbore that is at least partially lined with casing;

analytically dividing progress of a drill bit coupled to an end of the drill string sections as it drills the wellbore into a plurality of drilling intervals, wherein each drilling interval has a depth;

analytically dividing the casing into a plurality of casing sections, wherein each casing section has a length;

corresponding at least some of the plurality of casing sections with a drill string wear factor of the drill string section radially proximate to each of the plurality of casing sections for at least some of the plurality of drilling intervals; and analyzing a casing wear for at least one of the plurality of casing sections based on the drill string wear factors corresponding to the at least one of the plurality of casing sections.

* * * * *